US005855402A

United States Patent [19]

Maraschiello

[11] Patent Number: 5,855,402

[45] Date of Patent: Jan. 5, 1999

[54] RAIN GUTTER CLEANING TOOL

[76] Inventor: Victor Anthony Maraschiello, 228 Kenmure Dr., Flat Rock, N.C. 28731

[21] Appl. No.: 13,981

[22] Filed: Jan. 27, 1998

[51] Int. Cl.[6] ..... E04D 13/076

[52] U.S. Cl. ..... 294/19.1; 15/236.04

[58] Field of Search ..... 294/19.1, 22, 23, 294/50.8, 50.9, 103.1, 104; 15/105, 236.04; 56/333, 334

[56] References Cited

U.S. PATENT DOCUMENTS

| | | | |
|---|---|---|---|
| 2,720,409 | 10/1955 | Griffith | 294/19.1 |
| 2,817,867 | 12/1957 | Bugbird | 294/19.1 X |
| 3,601,835 | 8/1971 | Morgan | 294/19.1 X |
| 3,972,552 | 8/1976 | Earp | 294/19.1 |
| 4,057,276 | 11/1977 | Currie | 294/19.1 |
| 4,196,927 | 4/1980 | Lomaga | 294/19.1 |
| 4,930,824 | 6/1990 | Matthews et al. | 294/19.1 |

FOREIGN PATENT DOCUMENTS

| | | | |
|---|---|---|---|
| 480369 | 4/1953 | Italy | 294/22 |

*Primary Examiner*—Johnny D. Cherry
*Attorney, Agent, or Firm*—Hill & Simpson

[57] ABSTRACT

A rain gutter cleaning tool is provided wherein the tool is supported and carried on an elongated pole with a fixed handle at one end, an intermediate actuating handle and operating gripper jaw mechanism on the other end. The gripper jaws are disposed at an optimum angle for easy and convenient access to the open top of the conventional rain gutter and may be selectively actuated to remove leaves and accumulated debris from clogged gutters.

4 Claims, 3 Drawing Sheets

RAIN GUTTER CLEANING TOOL

BACKGROUND OF THE INVENTION

This invention relates generally to home tools and appliances and more particularly relates to a rain gutter cleaning tool which may be manually held and manipulated by a user for cleaning a rain gutter disposed at a relatively remote location, i.e., a rain gutter situated on the eave of an architectural structure such as a dwelling place, a garage, or a utility building and susceptible to malfunction due to the accumulation of fallen leaves and other yard debris.

THE PRIOR ART

Appliances heretofore provided in the prior art have included grasping tools or cutting tools disposed on the end of an extensible pole and including actuating means for permitting operation of the tool by a user. For example, there are such tools which are utilized in grocery stores for removing packaged articles from a shelf which may be disposed at an inaccessible location beyond the normal grasp of the user. Cutting and pruning tools are also provided in the prior art for cutting and or pruning twigs and branches of trees wherein the cutting instrument is disposed on the end of an extension pole and some form of operating means is provided so that the user may actuate the tool while standing a considerable distance from the branch or twig being cut or pruned.

As is well known to the average home owner charged with the responsibility of maintaining operative rain gutters, the accumulation of leaves and debris in the rain gutter can be an extremely annoying and destructive problem. When the gutter gets clogged, the down spout cannot function. Consequently, flow patterns inconsistent with good drainage and with adequate protection of the ambient environment are likely to develop which must be promptly attended to by the homeowner if extensive environmental damage is to be avoided. Further, clogged gutters are apt to leak streams of water on relatively unprotected areas of siding on the structure and may cause serious leakage and damage.

Accordingly, there is a need for a remotely operable gutter cleaning tool whereby the owner or occupant of a dwelling or the user of a garage or utility building may readily and conveniently clear leaves and accumulated debris from the rain gutters of the architectural structure without the necessity of exposing the user to the risks and dangers associated with climbing ladders, or the necessity of building a cumbersome scaffolding upon which to gain access to the elevated rain gutter.

SUMMARY OF THE INVENTION

In accordance with the present invention, there is provided a pole with a retention handle grip at one end shaped and configured to be grasped by the user. The pole extends a sufficient distance so that the other end of the pole may carry a gripper construction which features a pair of clamping jaws disposed at an optimum re-entrant angle of approximately 35° so that the user may readily access the interior of a rain gutter.

A sliding actuating handle is carried along an intermediate section of the pole and is operatively connected to the clamping jaws of the gripper construction by a lanyard made of nylon rope so that the jaws may be selectively opened and closed, thereby to grasp leaves and debris coming between the jaws. A return spring is provided for the gripper mechanism so that the jaws will quickly and conveniently be restored to an open release position when the tool is manipulated by the user to discharge the charge of leaves and debris from the jaws.

The position of the center of gravity of the gripper assembly relative to the support and operating mechanism makes the tool easy to hold and operate.

DESCRIPTION OF THE PREFERRED EMBODIMENTS

Figure 1:
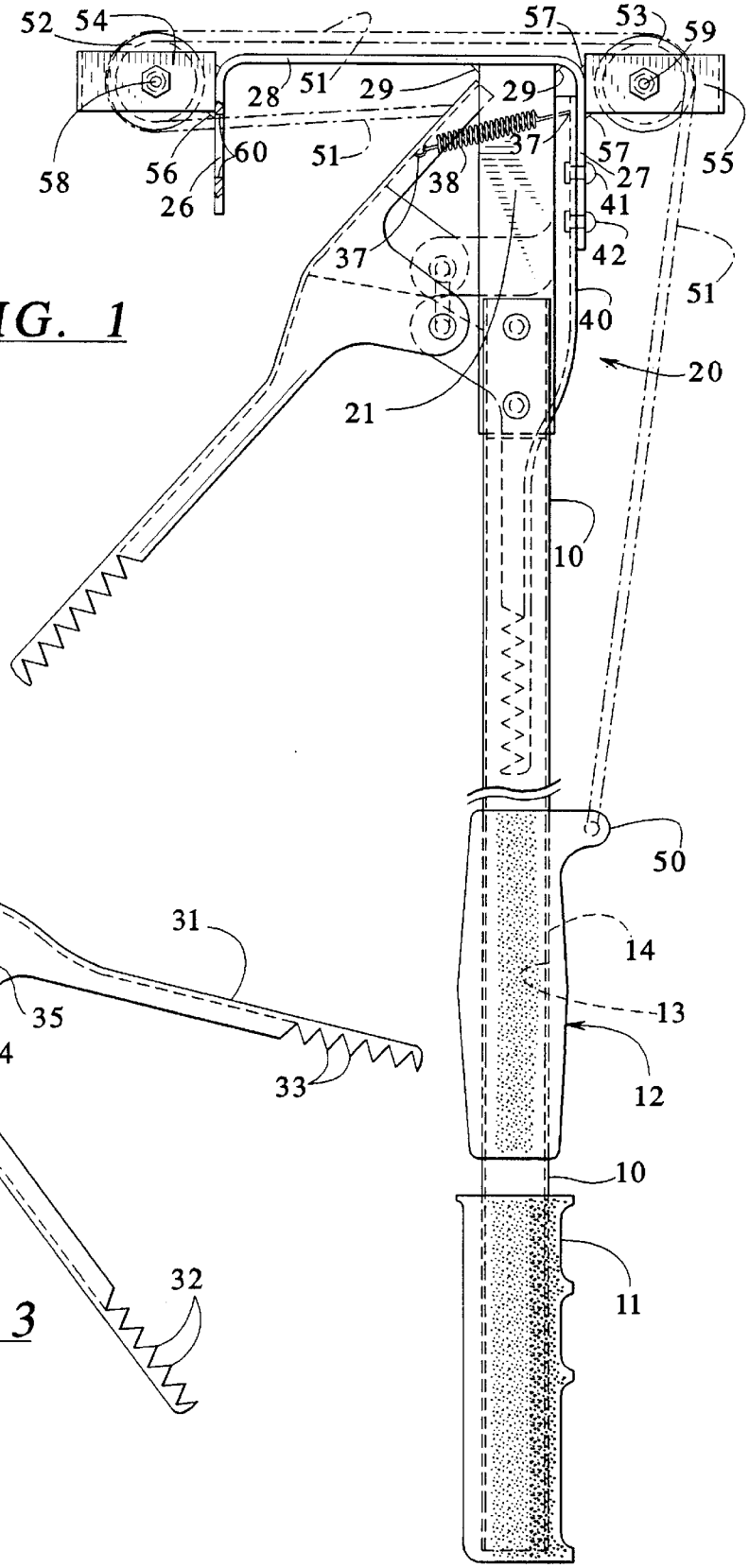
FIG. 1 is a front elevational view of the rain gutter cleaning tool provided in accordance with the principles of the present invention.

It will be understood that the description of the preferred embodiment that follows represents one structural exemplification of a device which is capable of practicing the principles underlying my invention. However, those versed in the art may elect to vary the actual structural features without departing from the essential concept.

Referring to the drawings, there is provided first of all a pole 10 which is preferably a cylindrical hollow metal member made of a rigid light weight aluminum, or the like. The pole 10 is an elongated member and forms a ward of a straight axial shape and extends on a common axis throughout its length. At one end of the pole 10, there is connected in firm assembly therewith a gripping handle 11 shaped and configured with an appropriate pistol contour to afford a good gripping surface with the hand or hands of a user. If desired, the pole 10 may be made of one, or more telescoping pieces, in the manner of vacuum cleaner tubes, i.e., in a manner well known to contemporary artisans. Thus, the pole 10 may be furnished in a convenient length suitable to afford the user access to a remotely situated rain gutter, but not so long as to be unwieldy, or clumsily ineffective in the course of operation.

In order to provide a manual actuating means for the tool, there is provided a sliding actuating handle 12 which essentially constitutes a cylindrical, or sleeve-like, body member having an inner cylindrical-through opening 13 of a size to be slidably supported on the outer diameter wall 14 of the pole 10. The outer surface of the handle 12 has a variable diameter to provide a grasping surface of the handle 12 which is congenial to the grip of the user, and which facilitates the reciprocating sliding action of the handle 12 on the outside surface of the ward or pole 10.

Figure 2:
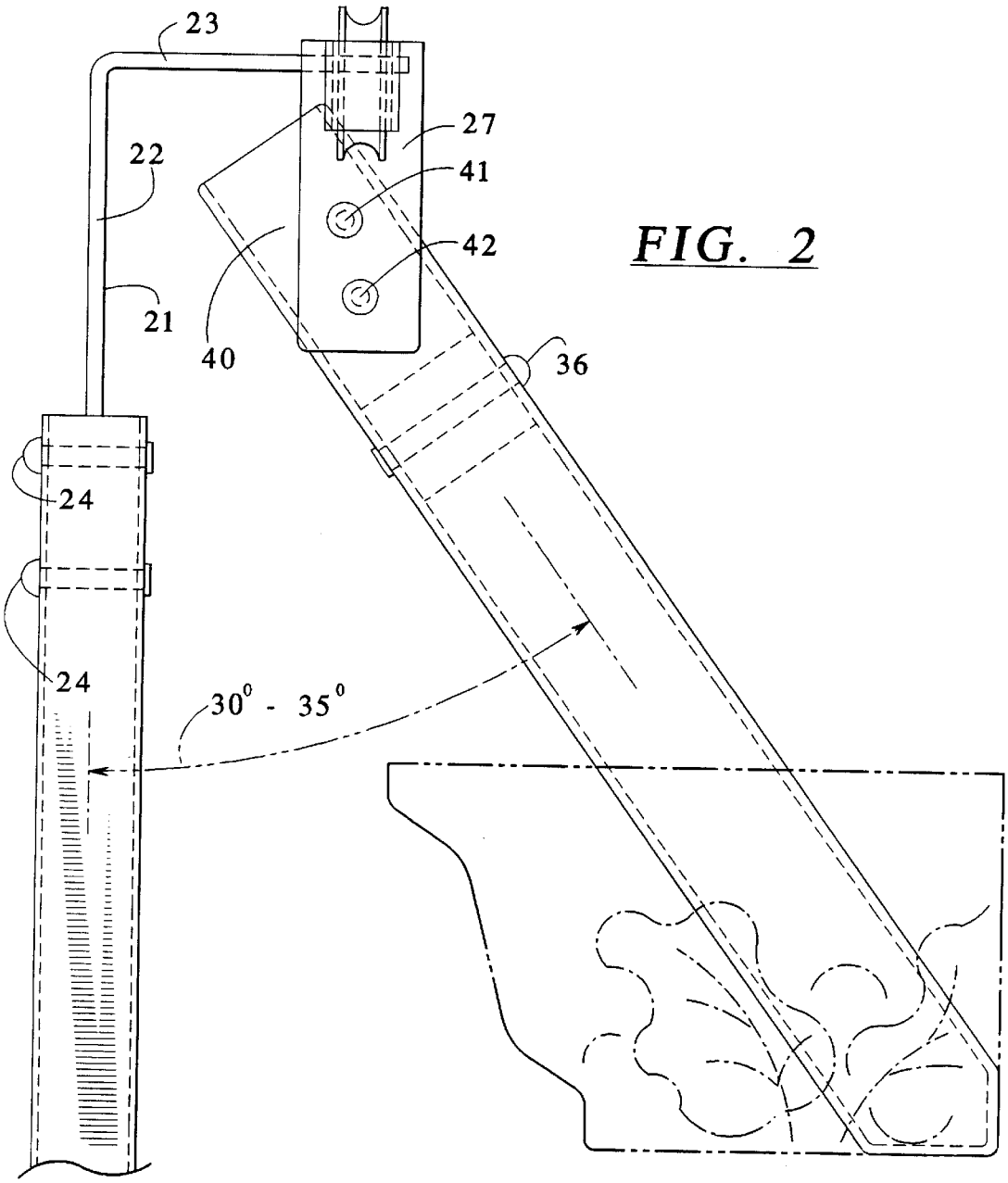
FIG. 2 is a fragmentary side elevational view of the tool of FIG. 1.

At the other end of the pole is provided the gripper construction or gripper mechanism of the present invention, and which will be referred to generally by the reference sign 20. Referring to FIG. 2 in connection with FIG. 1, it will be noted that there is provided a gripper support body 21 which is made of a rigid strip-form metal and is shaped to form a main leg 22 and bent at right angles to form an offset arm 23.

The main leg is bolted in firm assembly with the free end of the pole 10 by appropriate fastening means, for example, by means of a pair of bolts 24,24. The gripper support body includes a second component in the form of a strip-form metallic element bent to form a first vertical leg 26, a second vertical leg 27 and a horizontal leg 28 which joins the two, thereby to form what amounts to a bight portion. The horizontal leg 28 is joined in firm assembly with the offset arm 23 by means of weldments shown at 29.

Figure 3:
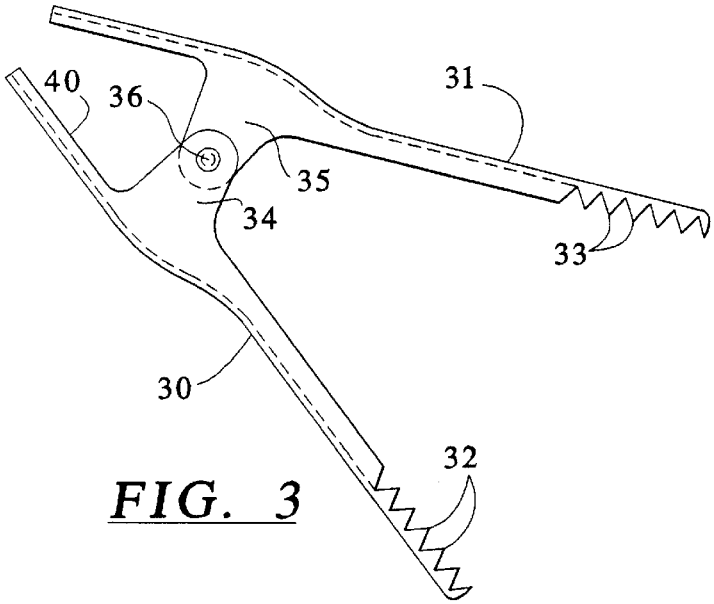
FIG. 3 is an enlarged elevational view of the gripper jaws utilized in the tool of FIGS. 1 and 2.

In accordance with the present invention, there is provided two legs forming a pair of gripper jaws which operate in a clamping function to selectively grasp material disposed between the jaws when they are moved towards one another. Referring to FIGS. 2 and 3, the jaws are formed by a first gripper member 30 and a second gripper member 31. Each jaw or gripper member 30 and 31 is formed as a sheet-form metallic part that is bent and shaped in a generally U-shaped cross-section, that is to say, each arm or leg of the jaw has side walls and a bottom wall, thereby to form a bight portion. At one longitudinal end of each gripper, the side walls thereof are formed with erose teeth 32 and 33, thereby to enhance and facilitate the grasping action of the jaws when the grippers 30 and 31 are closed.

The side walls are also medially formed with extended arms, thereby to form a fulcrum area 34 and 35, respectively, on the two grippers 30 and 31. The fulcrum areas 34 and 35 overlap one another and are inter-connected, or pivotally joined by a shaft 36. At the head end of each gripper jaw, there is provided a seat 37 against which a continuous biasing means such as a coil spring 38 is seated and connected, thereby to exert a continuous biasing force tending to draw the two head ends of the grippers together and opening the jaws 30 and 31 when they are not loaded in an opposite direction.

In order to connect the clamping device to the main body of the gripper assembly, a head end 40 of the gripper jaw 31 is connected to the second vertical leg 27 by a pair of spaced studs 41 and 42. Referring specifically to FIG. 2, it will be noted that the studs 41 and 42 are aligned in such a fashion and the lug forming the gripper jaw 31 is aligned relative to the vertical leg 27 that the gripper jaws 30 and 31 are disposed in a predetermined angular alignment relative to the main body and the pole 10, to wit, the included angle forms a re-entrant angle of approximately thirty (30)to thirty five (35) degrees. I have found that such degree of angulation provides easy access to the conventionally sized rain gutter found on most contemporary architectural structures.

In order to actuate the gripper jaws 30 and 31 selectively from a remote location, there is provided an actuating drive connection forming a drive train between the gripper jaws 30 and 31 and the actuating slide handle 12. First of all, the slide handle has a lug extension formed thereon as shown at 50 to which is connected one end of a lanyard or operating cord made of nylon rope and identified by the sign 51.

In order to selectively change the direction of the forces transmitted by the drive train through the nylon rope 51, a pair of idler glides are provided as identified at 52 and 53. The glides are each journalled for rotation in a bearing bracket 54 and 55, respectively. Each bracket 54 and 55 is formed by a U-shaped metal bracket welded firmly in place to the outer surfaces of the vertical leg 26 and the vertical leg 27, the respective weldments being shown at 56 and 57. An axle 58 is provided for the glide 52 and is mounted in the bearing bracket 54 and an axle 59 is provided for the glide 53 and is mounted in the bearing bracket 55.

The lanyard or nylon rope 51 is trained over the glide 53 and then passes parallel to the horizontal leg 28 whereupon it is trained over the glide 52 and returns through a clearance opening 60 formed in the vertical leg 26 for connection to the head end of the gripper jaw 31.

In operation, when the actuating slide 12 is pulled downwardly, the lanyard or nylon rope 51 pulls the gripper jaw 31 against the bias of the spring 38 closing the jaws and grasping the leaves and accumulated debris therebetween. The material is then transported to a removal site and when the actuating slide 12 is released, the jaws 30 and 31 open and the material is discharged, thereby conditioning the gripper to take on another charge of material. The optimum angle of the jaws (approximately 30 to 35 degrees) and the unique construction of the gripper jaws allow them to fit perfectly into the clogged gutter. Moreover, the position of the center of gravity offset relative to the gripper jaw assembly makes it easy to hold and operate the tool, particularly since both hands of the user can be on the tool throughout its operational cycle.

The utilization of the spaced glides on either side of the body assembly makes it easy to open and close the jaws with a minimum of operating force. Further, the spring loading via the return spring arrangement insures a quick release after the leaves are removed from the gutter.

Figure 4:
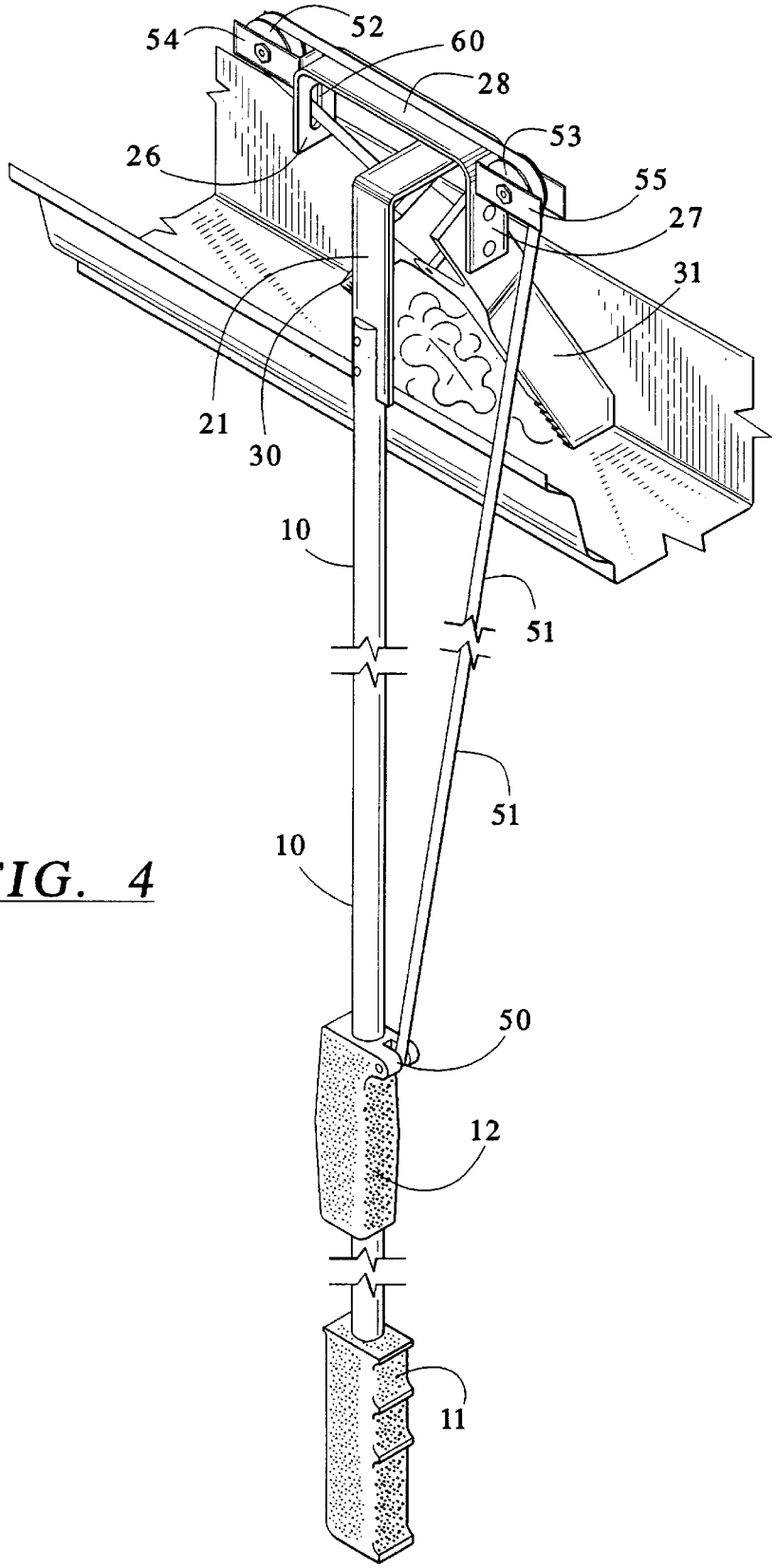
FIG. 4 is perspective view showing the tool of FIGS. 1–3 in an operating environment and illustrating the use of the tool.

FIG. 4 depicts how the gripper jaws 30 and 31 easily enter the opening in the conventionally sized rain gutter due to the optimum angulation of the gripper mechanism with respect to the pole.

Although minor modifications might be suggested by those versed in the art, it should be understood that I wish to embody within the scope of the patent warranted hereon all such modifications as reasonably and properly come within the scope of my contribution to the art.

I claim as my invention:

1. In combination, a rain gutter cleaning tool comprising, a hollow cylindrical pole made of lightweight aluminum, a stationary gripping handle on one end of the pole having a shaped contour to fit the hand of a user, a tubular actuating handle slidably carried on the pole and movable back and forth longitudinally to actuate the tool selectively, a stationary support body mounted in firm assembly with the opposite end of the pole, a lanyard rope forming a drive train and having one end connected to said actuating handle, glide means carried by said support body over which said lanyard rope is trained, and a pair of gripper jaws medially pivotally inter-connected together so that they may be relatively opened and closed with respect to one another, to develop a clamping action, one of said gripper jaws being firmly connected to said support body, the other of said gripper jaws being connected to said lanyard rope, spring means between said gripper jaws to bias said jaws open, whereby said rope may be selectively moved to relatively pivot said jaws thereby to open and close the jaws, said jaws being mounted in connected relation to said support body in such a manner that the gripper jaws are disposed at an optimum reentrant angle relative to the axis of the pole, thereby to facilitate access of the gripper jaws into a remotely located rain gutter by the user.

2. A rain gutter cleaning tool comprising:

a gripper having a pair of legs forming two jaw members and being pivotally inter-connected for relative rotation, thereby to move the jaw members towards and away from one another in a clamping action, each jaw member comprising a sheet-form element bent and shaped to provide spaced side walls joined by a bottom wall forming a bight portion, the side walls at one end of each jaw member being erose to form and provide a plurality of teeth disposed for enhancing the gripping action of the jaw members, the side walls at the other end of each jaw member forming a head for seating a coil spring normally loading the jaw members towards an open position, a pole forming an elongated wand on one end of which to mount said gripper to thereby project the jaw members of said gripper to a remote elevated position relative to a rain gutter, said pole having actuating means connected to said gripper, thereby to selectively open and close said jaw members, and mounting means connecting said gripper to said wand with said pair of legs disposed at a relative re-entrant angle with respect to said wand to optimize the entry of the jaw members into a rain gutter, thereby to grasp leaves and accumulated debris in the rain gutter.

3. A rain gutter cleaning tool as defined in claim 2 wherein the re-entrant angle between the wand and said pair of legs forming said jaw members is in the range of from about thirty to thirty five degrees.

4. A rain gutter cleaning tool as defined in claim 2 wherein said actuating means more particularly comprises:

a sliding handle mounted for reciprocal movement on the wand, glide means journalled for rotation on said one end of said wand, and a nylon rope connected to said sliding handle trained over said glide means and connected to one of said jaw members to selectively open and close said jaw members in response to reciprocation of said sliding handle on said wand.

* * * * *